US007635179B2

(12) United States Patent
Stephenson, III

(10) Patent No.: US 7,635,179 B2
(45) Date of Patent: Dec. 22, 2009

(54) ARRAY PRINTHEAD WITH THREE TERMINAL SWITCHING ELEMENTS

(75) Inventor: Stanley W. Stephenson, III, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 490 days.

(21) Appl. No.: 11/538,827

(22) Filed: Oct. 5, 2006

(65) Prior Publication Data

US 2008/0084456 A1 Apr. 10, 2008

(51) Int. Cl.
*B41J 2/05* (2006.01)

(52) U.S. Cl. ..... 347/58; 347/62

(58) Field of Classification Search ..... 347/5, 347/9, 12, 20, 50, 56–69
See application file for complete search history.

(56) References Cited

U.S. PATENT DOCUMENTS 5,134,425 A 7/1992 Yeung
6,120,135 A * 9/2000 Murthy et al. ..... 347/58
6,491,385 B2 12/2002 Anagnostopoulos et al.
6,722,759 B2 4/2004 Torgerson et al.
6,817,703 B2 * 11/2004 Lee ..... 347/57
6,911,666 B2 6/2005 Voutsas
6,921,156 B2 7/2005 Childers et al.
6,926,284 B2 8/2005 Hirst
6,969,158 B2 11/2005 Taira
2005/0104928 A1 5/2005 Edelen et al.

* cited by examiner

*Primary Examiner*—Juanita D Stephens
(74) *Attorney, Agent, or Firm*—William R. Zimmerli

(57) ABSTRACT

A print head includes a substrate with a plurality of row conductors arranged on the substrate, a plurality of column conductors arranged on the substrate, and a plurality of ejectors a arranged on the substrate in rows and columns. Each of the plurality of ejectors includes a resistive element arranged over the substrate and a supply passage through the substrate dedicated to each of the plurality of ejectors. A semiconductor device is associated with each resistive element. The semiconductor device is responsive to a signal from one of the plurality of row conductors or one of the plurality of column conductors to actuate the resistive element associated with the semiconductor device.

14 Claims, 9 Drawing Sheets

ARRAY PRINTHEAD WITH THREE TERMINAL SWITCHING ELEMENTS

CROSS REFERENCE TO RELATED APPLICATIONS

Reference is made to commonly-assigned, U.S. patent application Ser. No. 11/516,134, filed Sep. 6, 2006, entitled "LARGE AREA ARRAY PRINT HEAD EJECTOR ACTUATION" in the name of Stanley W. Stephenson, the disclosure of which is incorporated herein by reference.

FIELD OF THE INVENTION

This invention relates generally to the field of digitally controlled printing devices, and in particular to large area array print heads in which a plurality of ejectors are arranged in rows and columns.

BACKGROUND OF THE INVENTION

Ink jet printing systems apply ink to a substrate. The inks are typically dyes and pigments in a fluid. The ink-receiving substrate can be comprised of a material or object. Most typically, the substrate is a flexible sheet that can be a paper, polymer or a composite of either type of material. The surface of the substrate and the ink are formulated to optimize the ink lay down.

Ink drops can be applied to the substrate by modulated deflection of a stream of ink (continuous) or by selective ejection from a drop generator (drop-on-demand). The drop-on-demand (DOD) systems eject ink using either a thermal pulse delivered by a resistor or a mechanical deflection of a cavity wall by a piezoelectric actuator. Ejection of the droplet is synchronized to motion of the substrate by a controller, which electrical signals to each ejector with appropriate timing to form an image.

U.S. Pat. No. 6,491,385 describes a continuous ink jet head and it's operation. An linear array of ejectors is disposed on a substrate. Each nozzle has a unique supply bore through the substrate. The supply bore ejects fluid through a nozzle in a membrane across the front surface of the supply bore. The membrane supports layers that form a pair of semi-circular resistive elements around each nozzle. Each resistor pair is pulsed to break the stream of fluid into discrete droplets. Asymmetric heating of the resistors can selectively direct the droplets into different pathways. A gutter can be used to filter out select droplets, providing a stream of selected droplets useful for printing. The modulated stream printing system requires significant additional apparatus to manage fluid flow.

Piezoelectric actuated heads use an electrically flexed membrane to pressurize a fluid-containing cavity. The membranes can be oriented in parallel or perpendicular to the ejection direction. U.S. Pat. No. 6,969,158 describes a piezoelectric drop-on-demand ink jet head having an electrically responsive piezo membrane which forces fluids through a nozzle. The ink jet head is formed of a stack of plates, which includes the piezoelectric membrane. The membranes require a large amount of surface area, and multiple rows of ejectors are arrayed in depth across the head. Ejectors are arranged across the printing direction at a pitch of 50 dpi and are arrayed in the printing direction 12 ejectors deep on an angle theta to form a head having an effective pitch of 600 dpi. Such heads are complex, requiring multiple layers that must be bonded together to form passages to the nozzle. The materials comprising the head and the structures do not lend themselves to incorporating semiconductor switching elements.

U.S. Pat. No. 6,926,284 discloses a drop-on-demand inkjet head permitting single-pass printing. A single pass print head comprises 12 linear array module assemblies that are attached to a common manifold/orifice plate assembly. Droplets are ejected from the orifice by twelve staggered linear array assemblies that support piezoelectric body assemblies to provide drop-on-demand ejection of ink through the orifice array. The piezoelectric system cannot pitch nozzles closely together; in the example, each swath module has a pitch of 50 dpi. The twelve array assemblies are necessary to provide 600 dpi resolution in a horizontally and vertically staggered fashion.

The orifice array on the plate can be a single two-dimensional array of orifices or a combination of orifices to form an array of nozzles. In the printing application, the orifices must be positioned such that the distance between orifices in adjacent line is at last an order of magnitude (more than ten times) the pitch between print lines. The assembly is quite complex, requiring many separate array assemblies to be attached to the orifice plate thorough the use of sub frames, stiffeners, clamp bar, washers and screws. It would be advantageous to provide a staggered array in a unitary assembly with an integral orifice plate. It would be useful for the spacing between nozzles to be less than an order of magnitude deeper than is disclosed in this patent.

U.S. Pat. No. 6,722,759 describes a common thermal drop-on-demand inkjet head structure. The drop generator consists of ink chamber, an inlet to the ink chamber, a nozzle to direct the drop out of the cavity and a resistive element for creating an ink ejecting bubble. Linear arrays of drop generators are positioned on either side of an ink feed slot. Two linear arrays are fed by a common ink feed slot. Ink from the slot passes through a flow restricting ink channels to the ink chamber. A heater resistor at the bottom of the ink chamber is energized to form a bubble in the chamber and eject a drop of ink through a nozzle in the top of the chamber. A matching set of transistors is formed adjacent to each resistor to provide a three-terminal switching device to each resistor. Sets of traces are provided adjacent to the transistors to provide power, power return and switching logic to each transistor. The structure limits nozzles to be placed in linear rows on either side of the ink jet supply slot. The patent uses both power supply and return lines, increasing the complexity of the device.

U.S. Pat. No. 5,134,425 discloses a passive two-dimensional array of heater resistors. The structure and arrangement of the droplet generators is not disclosed. The patent discloses the problem of power cross talk between resistors in two dimensional arrays of heater resistors. Voltages firing a resistor also apply partial voltages across unfired resistors. The parasitic voltage increases as the number of rows is increased to a maximum of 5 rows. The patent applies partial voltages on certain lines to reduce the voltage cross talk. The partial energy does not eject a droplet, but maintains a common elevated temperature for both fired and unfired nozzles. Passive matrix arrays of resistors are limited in the depth of the array because of the parasitic resistance. The patent suggests that the number of rows is limited to less than five rows.

U.S. Pat. No. 6,921,156 discloses forming inkjet heads on non-silicon flat-panel substrates. Thin film transistors are coupled to an array of ink jet drop generators. The monolithic substrate is described as being made of any suitable material (preferably having a low coefficient of expansion) and discloses a preferred embodiment of being ceramic. The device is multiplexed driven using flip chip devices bonded to conductors using solder. A single ink feed channel supplies two rows of nozzles. The resistors and chambers are formed using thin film processes. Multiple feedholes can supply each ejector from a single, common manifold for the two rows of ejectors. Reference to the thin film transistors on the substrate is limited, describing them as driving the resistors. The thin-film devices are formed over barrier and/or smoothing layers to isolate the thin-film devices from the substrate.

It would be useful to have a structure for an inkjet head that dispersed the nozzles in an array structure useful for high-speed printing. It would be useful to disperse ejectors in more than two columns. It would be useful for ejector arrays with a large number of rows to not have parasitic resistance.

SUMMARY OF THE INVENTION

It is an object of this invention to provide a compact, simple, large area print head. It is an objective of this invention to provide a minimal number of connections in a head having ejectors organized in rows and columns. It is a further object of this invention to minimize the depth and size of the array and complexity of the build process.

According to one aspect of the invention, a print head includes a substrate with a plurality of row conductors arranged on the substrate, a plurality of column conductors arranged on the substrate, and a plurality of ejectors a arranged on the substrate in rows and columns. Each of the plurality of ejectors includes a resistive element arranged over the substrate and a supply passage through the substrate dedicated to each of the plurality of ejectors. A semiconductor device is associated with each resistive element. The semiconductor device is responsive to a signal from one of the plurality of row conductors or one of the plurality of column conductors to actuate the resistive element associated with the semiconductor device.

According to another aspect of the invention, a method of actuating print head ejectors includes providing a substrate; providing a plurality of row conductors arranged over the substrate; providing a plurality of column conductors arranged over the substrate; providing a plurality of ejectors arranged on the substrate in rows and columns, each of the plurality of ejectors including a resistive element arranged over the substrate and a supply channel through the substrate dedicated to each of the plurality of ejectors; providing a semiconductor device associated with each resistive element, the semiconductor device being responsive to a gate signal from one of the plurality of row conductors or one of the plurality of column conductors and voltage from the other of the plurality of row conductors or one of the plurality of column conductors, the semiconductor device being electrically connected to the substrate; actuating a row of ejectors by providing power corresponding to an actuating state or a non-actuating state to each column conductor; and providing an enabling gate signal to one of the row conductors; and actuating another row of ejectors by repeating steps a. and b. for another row of ejectors.

BRIEF DESCRIPTION OF THE DRAWINGS

In the detailed description of the example embodiments of the invention presented below, reference is made to the accompanying drawings, in which.

DETAILED DESCRIPTION OF THE PREFERRED EMBODIMENT

Figure 1:
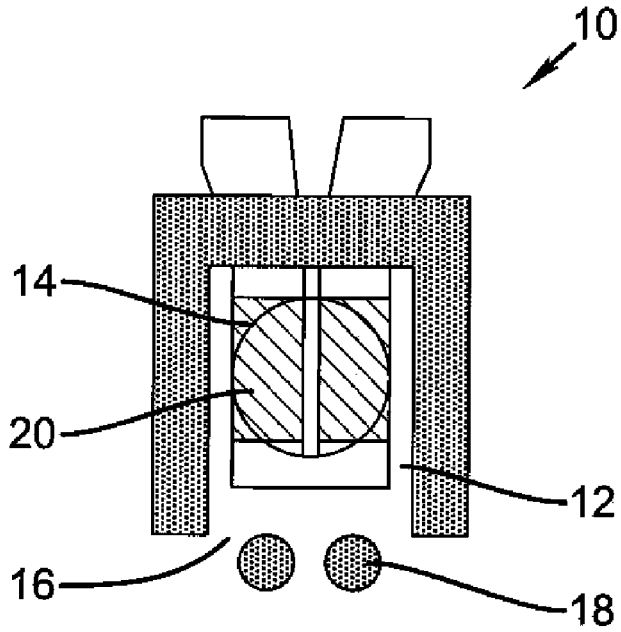
FIG. 1 is a top schematic view of an ejector in accordance with the present invention.
Figure 2:
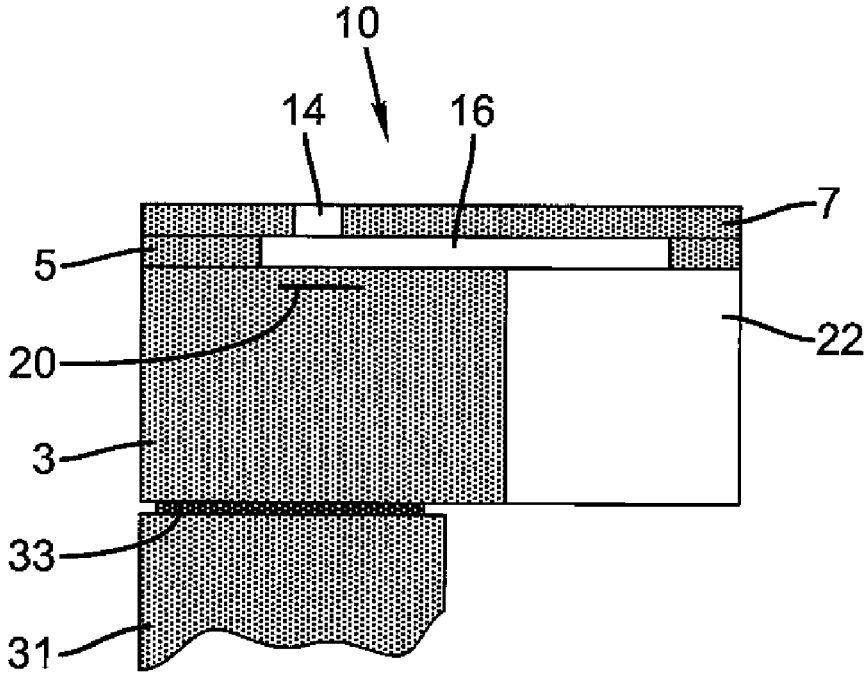
FIG. 2 is a side sectional view through the ejector shown in FIG. 1.

FIG. 1 is a top schematic view of an ejector 10 in accordance with the present invention. FIG. 2 is a side sectional view through the ejector shown in FIG. 1. A substrate 3 supports a polymer layer 5. Substrate 3 is most commonly a silicon wafer, however substrate 3 can be made of a glass or metal such as stainless steel, Invar, or nickel. An ink chamber 12 is formed as a cavity in polymer layer 5 to hold a printing ink. A cover 7 over ink chamber 12 can be formed directly over polymer layer 5 using a vacuum deposited ceramic, polymer or metal. Cover 7 over ink chamber 12 can also be a separate plate formed of ceramic, polymer or metal which is bonded to the polymer layer 5 defining ink chamber 12. Cover 7 has an opening to form a nozzle 14 to direct an ejected droplet of ink in a specified direction when ink chamber 12 is pressurized.

A heater resistor 20 is embedded in the substrate 3. A pulse of electrical energy to heater resistor 20 causes ink within ink chamber 12 to momentarily be converted into a gaseous state. A gas bubble is formed over heater resistor 20 within ink chamber 12, and pressurizes ink chamber 12. Pressure within ink chamber 12 acts on ink within ink chamber 12 and forces a droplet of ink to be ejected through nozzle 14. Inlet 16 supplies ink to ink chamber 12. Restriction 18 can be formed at inlet 16 to improve firing efficiency by restricting the majority of the pressure pulse to ink chamber 12. Restriction 18 can be in the form of one or more pillars formed within inlet 16, or by a narrowing of the sidewalls in polymer layer 5 at inlet 16 of ink chamber 12.

Resistive heads are commonly made using silicon for substrate 3. Heater resistor 20 and associated layers are formed over substrate 3, followed by polymer layer 5. Polymer layer 5 is patterned, followed by cover 7, which is patterned to form nozzle 14. After those layers have been formed, ink feed slot 22 is formed through substrate 3 using a reactive ion milling process. The reactive ion milling process has the characteristic of forming near-vertical walls through a silicon substrate 3. The ion milling process has the virtue that the process is specific to silicon and can form ink feed slot 22 without damage to structures associated with ejectors 10 on substrate 3. Substrate 3 is bonded to head holder 31 which has one or more cavities for supplying ink to some or all of ejectors 10 formed on substrate 3. In the invention, electrical current used to power resistors 20 is returned through substrate 3. In one embodiment, head holder 31 is formed of an electrically conductive metal, such as steel or aluminum, and electrical power from substrate 3 passes through electrically conductive adhesive 33, which secures substrate 3 to head holder 31. Conductive adhesive 33 should have low electrical resistance, less than 0.1 ohms resistance, to current flow between head holder 31 and substrate 3. Alternatively, power can be removed from substrate 3 using contacts formed around the perimeter of substrate 3. Each ejector 10 is fed by a cavity in head holder 31 through its ink feed slot 22 in substrate 3. Each ink feed slot 22 is associated with an individual ejector 10 and is physically separated from other ejectors 10 by the material forming substrate 3.

Figure 3:
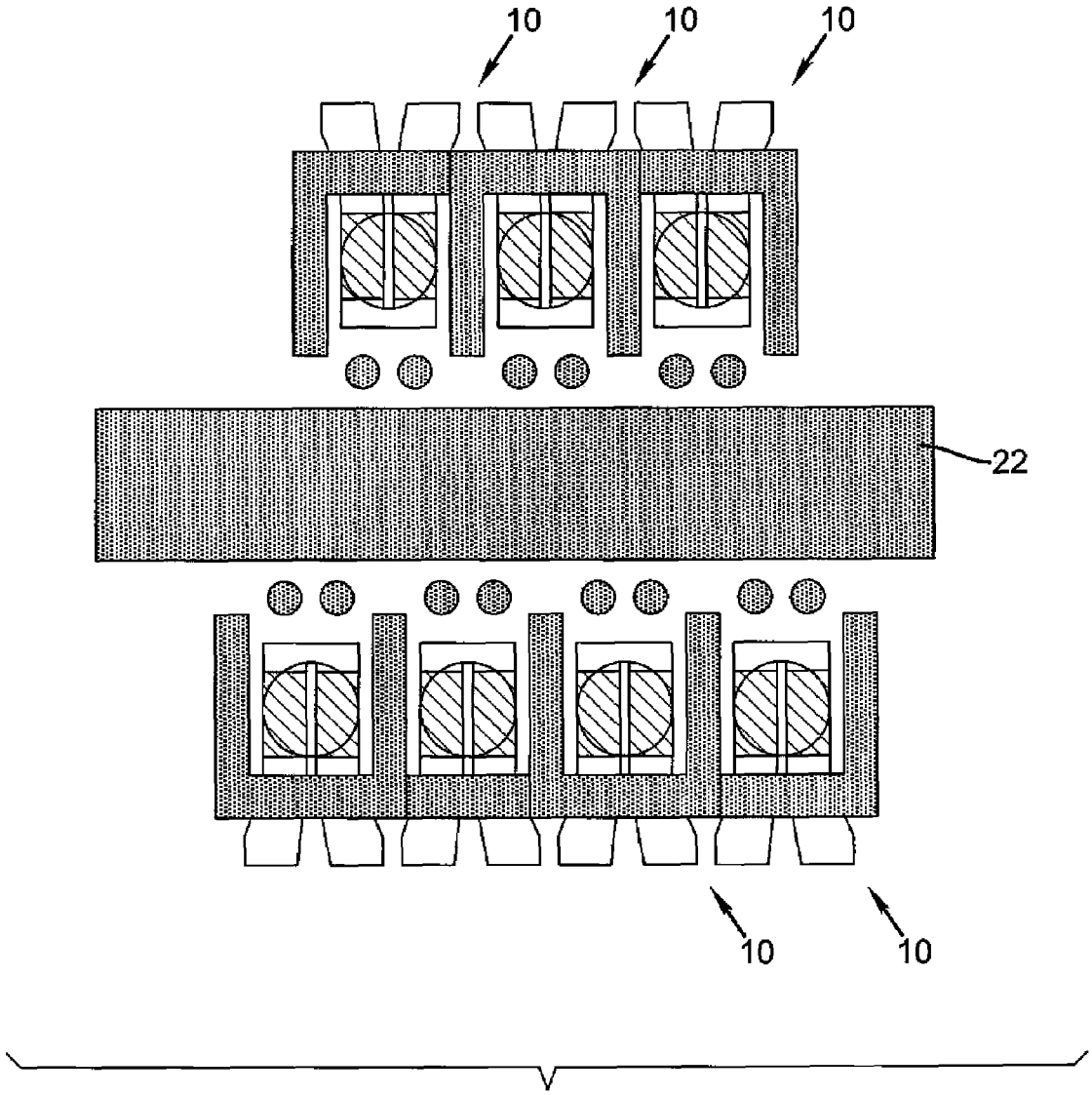
FIG. 3 (PRIOR ART)
FIG. 3 is a top view of an array of ink ejectors according to prior art.

FIG. 3 is a top view of an array of ink ejectors according to prior art. Ejectors 10 must be supplied by ink from the rear side of substrate 3. U.S. Pat. No. 6,722,759 is an excellent recitation of prior art associated with thermal drop-on-demand print heads. Ejectors 10 are arranged in two closely packed rows that share common ink feed slot 22. Ink feed slot 22 passes through substrate 3, which supplies to ink to multiple ejectors 10. Arranging two linear rows of ejectors 10 on either side of ink feed slot 22 provides for a compact ink jet head. Because the nozzles are adjacent to each other, fluidic cross-talk can occur between ejectors 10. Close packing of the nozzles makes the head susceptible to thermal cross-talk between adjacent nozzles. Overheating can become more pronounced if substrate 3 is not silicon, but a less thermally conductive material such as glass, ceramic, polymer or metal.

Figure 4:
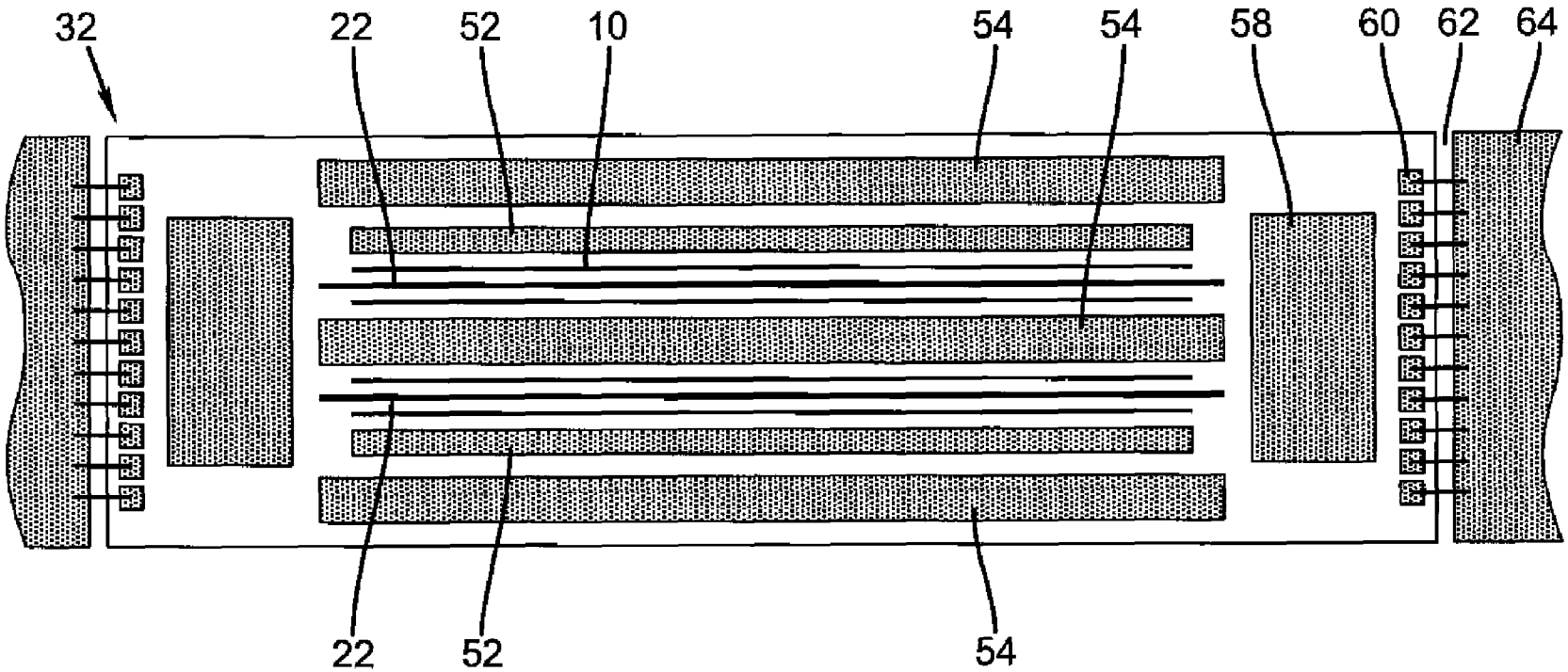
FIG. 4 (PRIOR ART)
FIG. 4 is a top view of an inkjet print head assembly in accordance with prior art.

FIG. 4 is a top view of an inkjet print head in accordance with prior art. The recitation again generally follows the structures found in U.S. Pat. No. 6,722,759. A print head 32 has two ink feed slots 22, each feed slot feeding two rows of ejectors 10. A set of ejector drivers 52 is formed adjacent to each row of ejectors 10. Each ejector driver 52 is a semiconductor-switching element that is attached to each heater resistor 20 within each ejector 10. The power requirements for thermal drop on demand inkjet are high, typically over 1 watt of power for approximately 1 microsecond. Ejector drivers 52 are typically formed of PMOS or NMOS transistors which are activated to selectively apply power to heater resistors 20. Alternatively, ejector drivers 52 can be formed of thin-film-transistor elements having characteristics capable of meeting the power and switching times required to thermally eject a droplet from an ejector 10.

Power to ejector drivers 52 is provided by conductor lines 54 disposed on the sides and down the center of substrate 3. Conductor lines 54 supply power and data for ejector drivers 52. Control logic 58 is disposed on both sides of the substrate 3 to decode data signals from printer controller 38 (not shown in figure). Data and power are delivered to control logic 58 through bond pads 60. Wire bonds 62 provide connection between bond pads 60 on substrate 3 and flex circuit 64. Data from control logic 58 is delivered through flex circuit 64 through wire bonds 62 to control logic 58. Control logic 58 responds to control data from printer controller 38 (not shown in this figure).

Figure 5:
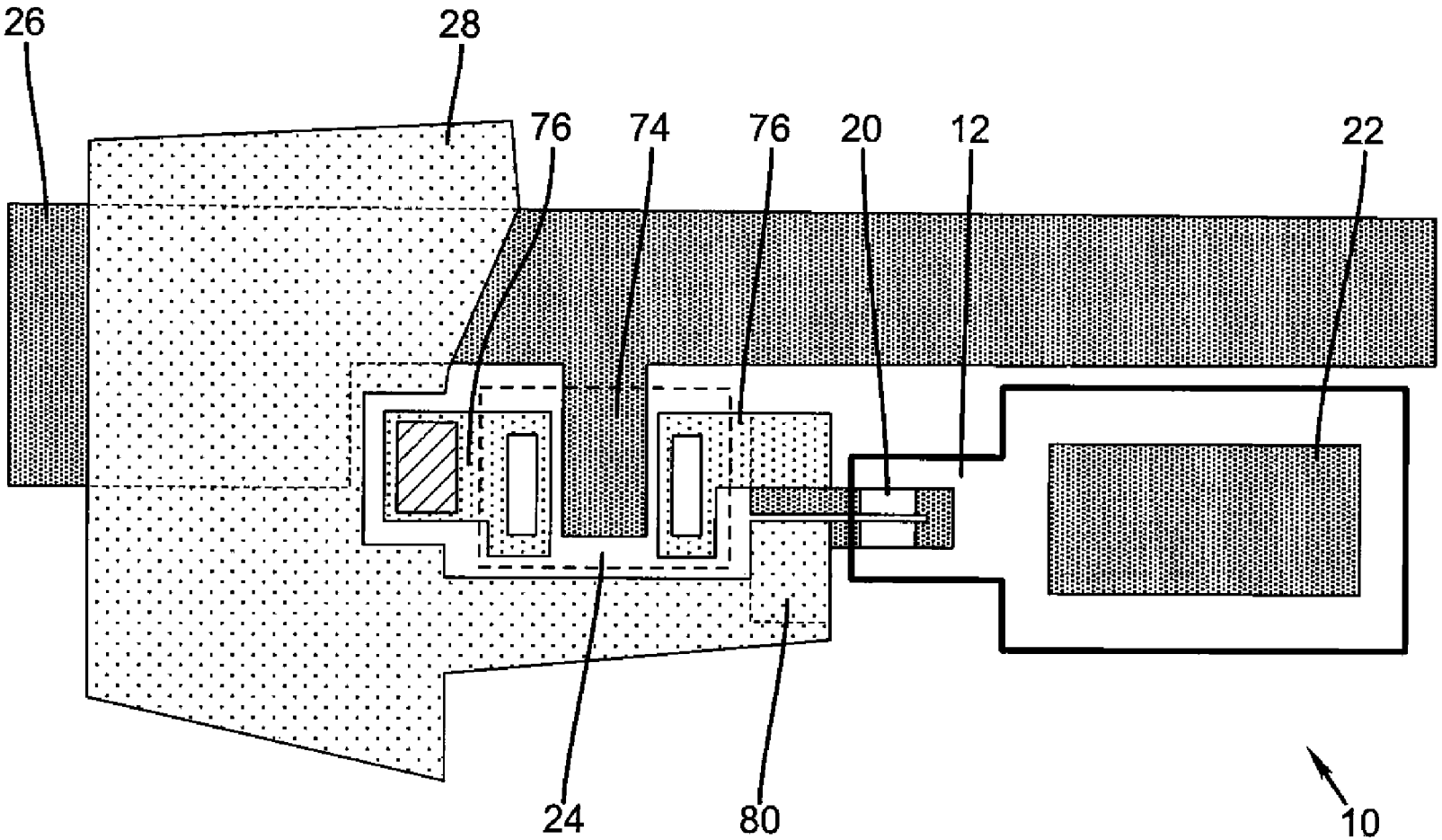
FIG. 5 is a top view of an ejector in accordance with the present invention.

FIG. 5 is a top schematic view of an ejector in accordance with the present invention. In the invention, an ejector 10 comprises an ink chamber 12 actuated by heater resistor 20. Ink chamber 12 is fed by inlet 16 and ejects fluid through nozzle 14 (not shown) over resistor 20. Dedicated ink feed slot 22 is integral with ejector 10. In the case that substrate 3 is made of silicon, a reactive ion etching process creates a substantially columnar ink feed slot 22 through substrate 3. Ink feed slot 22 shares a common cavity in head holder 31 facing the back of substrate 3. Ejector 10 in accordance with the invention provides a complete assembly that can be positioned at any distance from adjacent ejectors 10 to eliminate fluidic cross talk and improve cooling efficiency. In the case that substrate 3 is not silicon, the greater distance prevents overheating that would result from closely spaced ejectors 10 on lower conductivity substrates 3.

U.S. Pat. No. 5,134,425 discloses a passive two-dimensional array of heater resistors. The patent discloses the problem of power cross talk between resistors in two-dimensional arrays of heater resistors. A voltage applied to one resistor applies partial voltages across unfired resistors, significantly increasing the current and power demand. In the present invention, a three-terminal device, generally referred to as a transistor 24, permits multiple ejectors 10 to be attached to a matrix of row conductors 26 and column conductors 28 and eliminates power cross-talk. Row conductor 26 provides a digital logic signal to gate power supplied by column conductor 28. In this way, transistors 24 provide both a power and logic multiplexing using either row conductor 26 or column conductor 28 to provide power to resistor 20 when a gating voltage is applied on the other conductor. Transistors 24 and individual ink feed slots 22 permit ejectors 10 to be organized on substrate 10 in large numbers of both columns and rows.

Transistor 24 can be fabricated in several ways. For example, when substrate 3 is a single crystalline semiconductor material such as silicon, transistor 24 can be included in substrate 3 by appropriately doping portions of the single crystalline semiconductor material forming substrate 3. Alternatively, transistor 24 can be arranged over substrate 3 and be formed by a plurality of thin film material layers over substrate 3.

Figure 6:
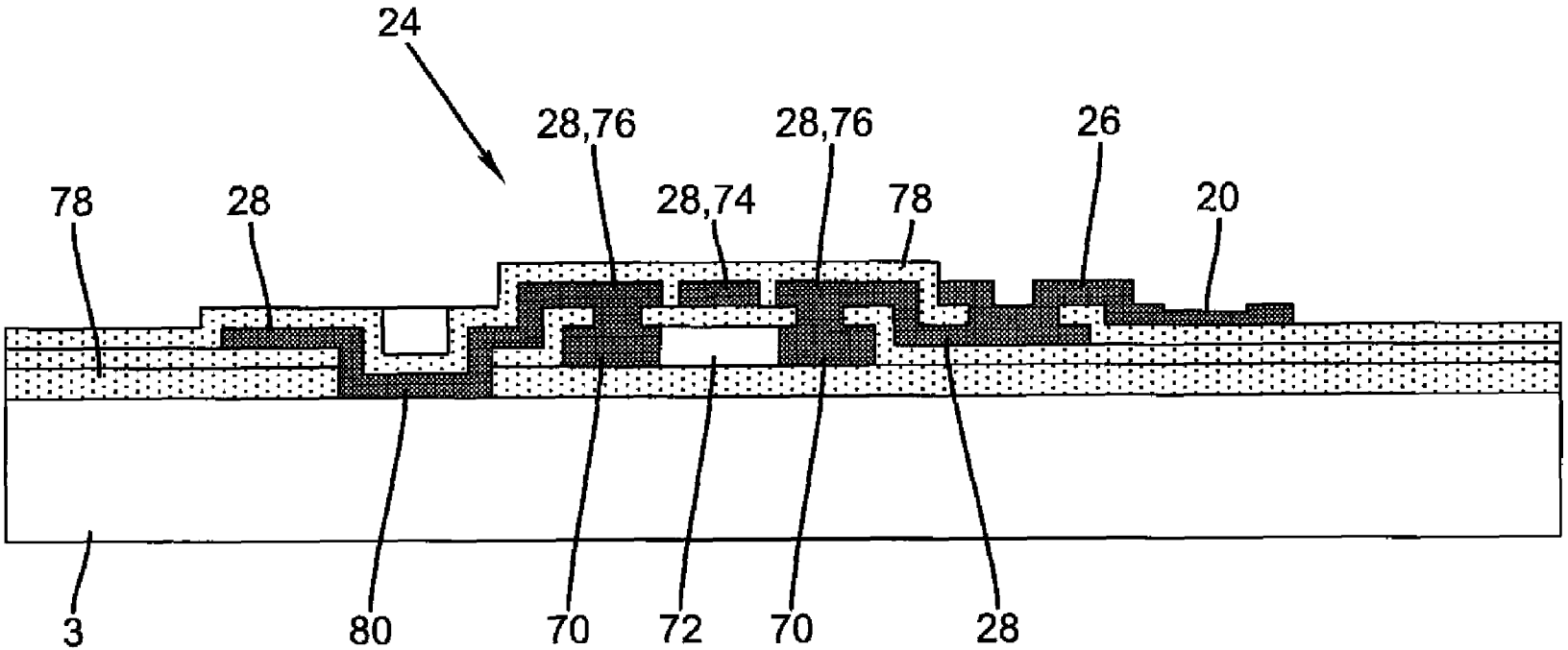
FIG. 6 is a side sectional view of a transistor on a substrate in accordance with the invention.

FIG. 6 is a side sectional view of transistor on a substrate in accordance with the invention. In the example, transistors 24 are thin-film transistors formed over dielectric layer 78 over substrate 3. Two doped areas 70 provide pools of charge in a semiconductor material, such as polysilicon. Channel 72 is disposed between doped areas 70 and is responsive to a field applied to gate electrode 74. The presence of a field on gate electrode 74 permits current to flow between doped areas 70. Various levels and types of n or p dopants can be applied to doped areas 70 and channel 72 to change the characteristics of transistor 24. Transistor contacts 76 are applied through dielectric 78 to supply power through transistor 24. In the invention, transistor contacts 76, for example, a first electrical contact and a second electrical contact, are formed of the material comprising row conductors 26 to minimize layers. In the case that substrate 3 is silicon, doped areas 70 and channel 72 are formed in the substrate through diffusion methods.

In the exemplary embodiment, gate electrode 74 and transistor contacts 76 are isolated areas of the material providing row conductor 26. An opening is made through dielectric layers 78 to provide substrate contact 80 between one transistor contact 76 and substrate 3. In the invention, two of the device terminals provide switching and power means, which are through gate electrode 74 and the transistor contact 76 not connected to substrate 3. The power return is through the substrate using substrate contact 80. In the invention, it is important that the substrate provide sufficient conductivity that the power delivered to multiple ejectors 10 be transmitted through substrate 3. In the case of very wide heads, the number of ejectors can be large, and applied power can be high. In the case that substrate 3 is silicon, the silicon must be heavily doped with either p or n type dopants to raise the conductivity of the wafer to a high level, below 1 ohm-centimeter, and preferably below 0.01 ohm-centimeter. Either n doping or p doping, with n dopants having the greater effect on reducing substrate resistance, can form doped silicon materials having such low resistance. In the case that substrate 3 is silicon and the substrate is highly conductive, row conductors 26 and column conductors 28 are isolated from the conductive substrate by dielectric 78. The embedded transistor 24 can also be isolated from the conductive silicon substrate 3 by the use of epitaxial layers as shown on page 306 of "Microchip Manufacturing", by Stanley Wolf, ISBN 0-9616721-8-8. In the case that substrate 3 is a non-silicon substrate, a metal is the preferred material. A preferred metal is stainless steel that has been straightened and polished. Conducting power back through the substrate eliminates additional layers and components. The structure permits row conductors 26 and column conductors 28 to be thin, and ejectors 10 can be packed closely together.

Column conductors 28 are formed over dielectric layer 78 and have through via to connect to isolated areas of conductor 26 which forms a transistor contact 76 to complete the circuit. The structure of the matrix electrical backplane of the invention uses two metal layers spaced from substrate 3 by dielectric layer 78 and spaced from each other by a dielectric layer 78. The structure provides a logic and power matrix inkjet array backplane with a minimal number of layers.

Figure 7:
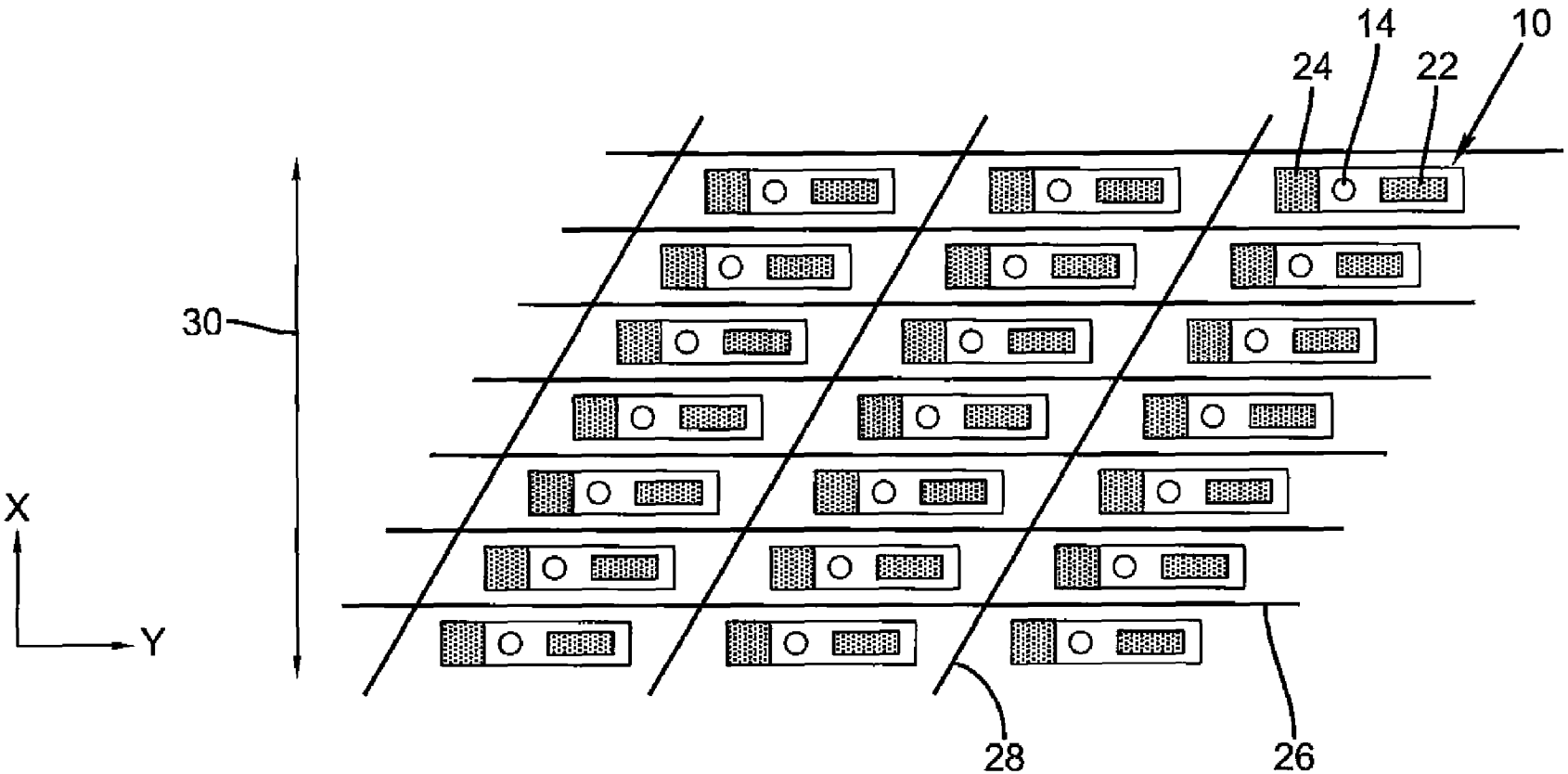
FIG. 7 is a schematic representation of an ejector array in accordance one example embodiment of the invention.

FIG. 7 is a schematic representation of an ejector array in accordance one example embodiment of the invention. A coordinate system is shown and includes a first direction X with X an axis of motion between the printhead and an ink-receiving surface, commonly referred to as a printing direction. A second direction Y is also shown with Y being a cross printing direction. A direction Z is also shown with Z being a direction perpendicular to the printhead. This is commonly referred to as the direction of ink drop ejection from the printhead.

Ejectors 10 are shown schematically as a box having individual supply ports 22 and nozzles 14 and transistors 24. Ejectors 10 have been attached to a matrix of row conductors 26 and column conductors 28 to form laterally staggered columns of ejectors 10. Each ejector 10 of a column of ejectors is staggered at a desired pitch, typically expressed in dpi or microns, which is finer than the pitch of the ejector columns. For example, each column can be pitched 600 microns apart due to the area required for each ejector. If the required printing pitch is 40 microns, each ejector in the column can be laterally staggered 40 microns to a depth of 15 ejectors (40×15=600) to achieve the required 40 micron printing pitch. The invention permits the staggered matrix array to be placed on a single substrate. Transistors 24 attached to ejectors 10 using row conductors 26 as the gate lines and column conductors 28 as power supply lines permit thermal Drop-On-Demand print heads having a large number of rows along printing direction X with close packing.

The embodiments shown in FIG. 7 is particularly well suited for print heads having large area arrays, for example, print heads having a print width across the Y direction of over of 100 millimeters and a print depth dimension Y of 18 millimeters. However, the large area array print head can have other length and width dimensions. One head (or a plurality of large area array print heads stitched together) can be used to form a pagewide print head. In a pagewide print head, the length of the printhead is preferably at least equal to the width of the receiver and does not "scan" during printing. The length of the page wide printhead is scalable depending on the specific application contemplated and, as such, can range from less than one inch to lengths exceeding twenty inches.

Figure 8:
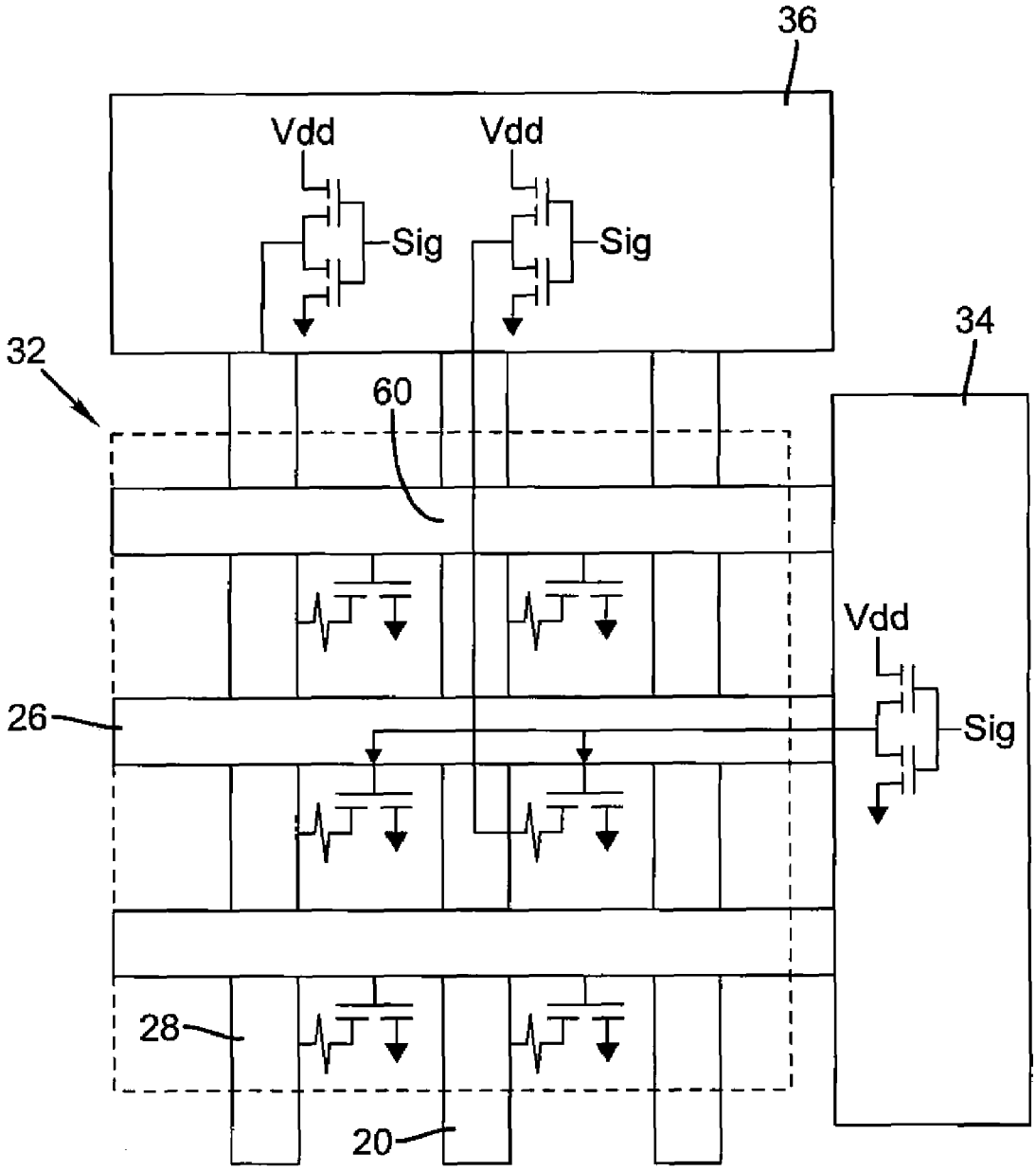
FIG. 8 is an electrical schematic of an ink jet head in accordance with the present invention.

FIG. 8 is an electrical schematic of an ink jet head in accordance with the present invention. Print head 32 includes a plurality of drivers electrically connected to the plurality of row conductors and the plurality of column conductors. The plurality of drivers are operable to provide current to each resistive element row sequentially. In FIG. 8, each column conductor 28 is connected to a column driver 36. Column driver 36 can be, for example, an ST Microelectronics STV 7612 Plasma Display Panel Diver chip that is connected to each column conductor 28. The chip responds to digital signals to either apply a drive voltage or ground to each column conductors. Each row conductor 26 is connected to a row driver 34. Row driver 34 can be the same ST Microelectronics STV 7612 Plasma Display Panel Diver chip to provide either a gating voltage (Vdd) or ground to each row conductor 26. Transistor 24, provided with each ejector 10, responds to the logic and power states to permit print head 32 to be logically driven in a row sequential fashion without parasitic resistance effects.

Print head 32 is fired row sequentially. Digital signals apply a drive voltage (Vdd) or ground voltage to each column conductor 28. Column conductors 28 having an applied drive voltage provide energy to the ejector attached to column conductor 28 and the grounded row conductor 26. Column conductors 28 at ground voltage are not fired. Row driver 34 applies a Gate voltage (Vdd) to a row of ejectors 10 to enable firing of powered ejectors 10 of a given row, while the remaining rows remain at ground voltage regardless of power applied to their associated column conductor 28. This process is repeated to apply an image wise pattern of ink droplets from print head 32.

Only a single ejector 10 on any given column conductor 28 is active at any one time, which permits column conductor 28 to be thin. However, all ejectors 10 on the selected row conductor 26 can be fired, which represents a large amount of current and power that must be returned through substrate 3. In a head having thirty activated heater resistors 20 on a line, each sinking 50 milliamperes, 1.5 amps will pass through substrate 3. Power from each ejector 10 must pass through contact 80, substrate 3 and through conductive adhesive 33 in the case that power is transmitted through head holder 31. The edges of substrate 3 can provide a large amount of surface area to transmit the power, in particular wide print heads will have large contact areas that will scale with width.

Figure 9:
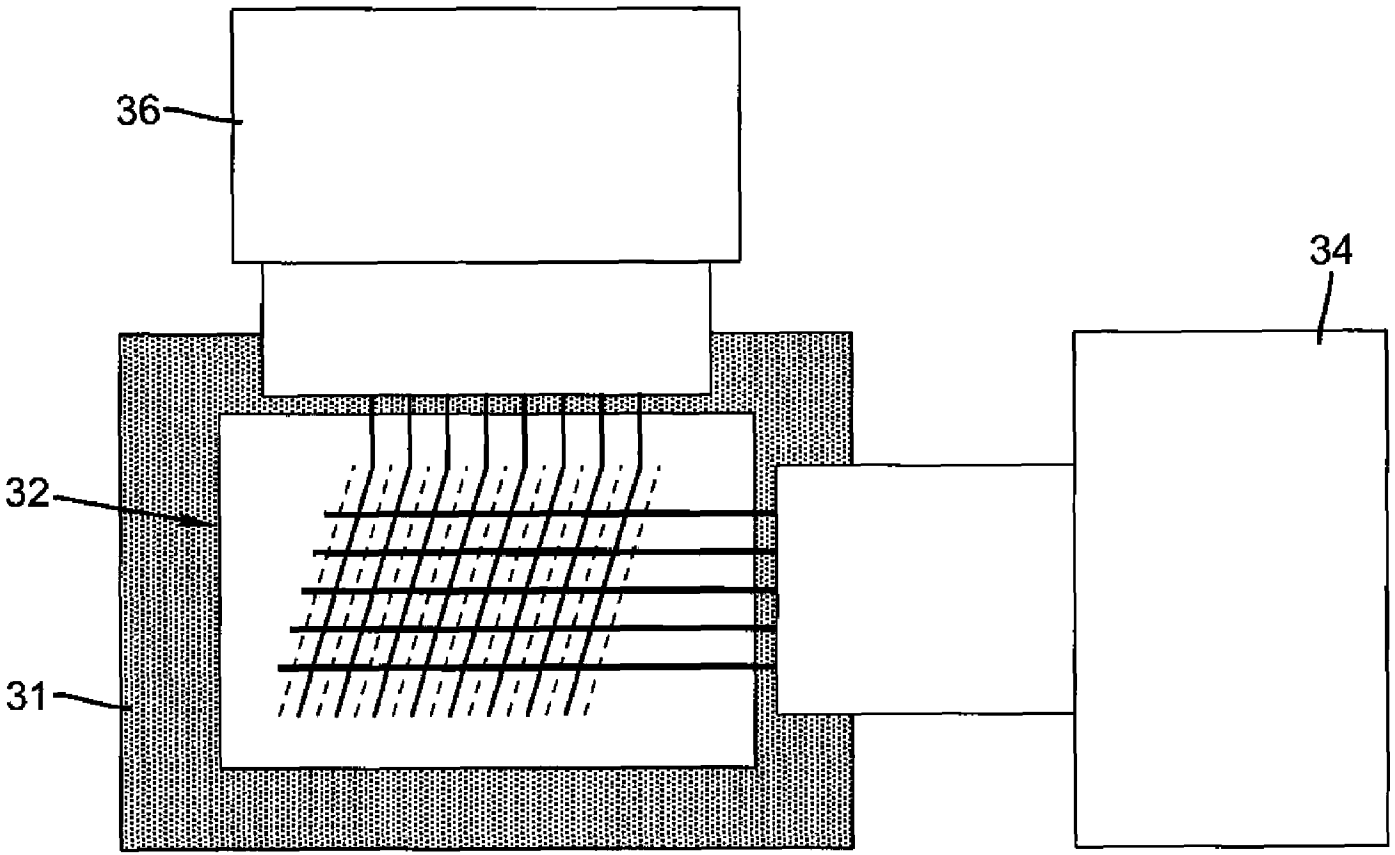
FIG. 9 is a schematic view of a head assembly in accordance with the present invention.

FIG. 9 is a schematic view of a head assembly in accordance with the present invention. Print head 32 has been mounted to head holder 31, which holds a supply of ink in a cavity behind substrate 3 to supply ink through substrate 3 to ejectors 10 mounted on the front of substrate 3. Row driver 34 and column driver 36 are attached to head holder 31 and wire bonds are made between the flex circuit for the drivers to the row and column conductors on print head 32. The width of the head is not limited to a single column driver 36. The width can be extended and additional column drivers 36 added to provide power to additional columns.

Figure 10:
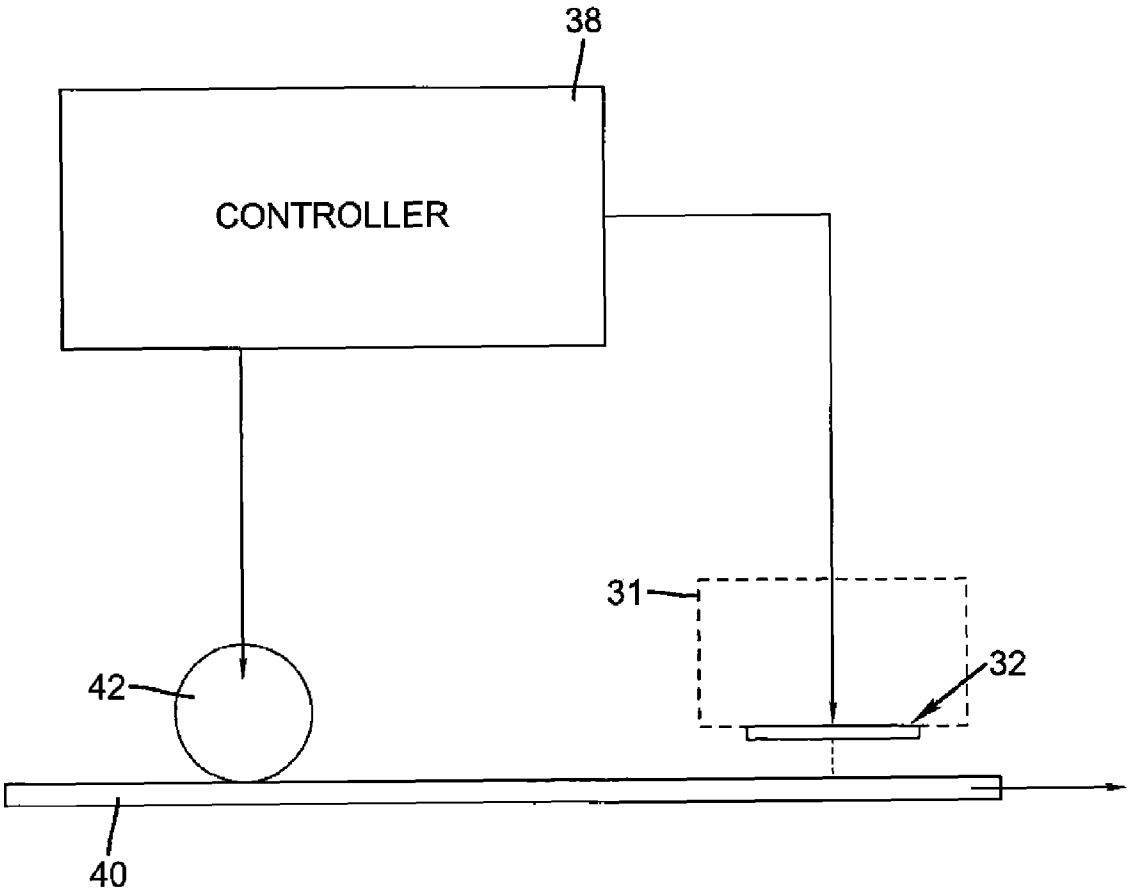
FIG. 10 is a side view of a printer using a head in accordance with the present invention.

FIG. 10 is a schematic side view of a printer using a head in accordance with the present invention. Controller 38 moves an ink receiver 40 using receiver driver 42. Receiver driver 42 is a motor that operates on a plate or roller to drive ink receiver 40 under print head 32. Controller 38 provides drive signals to row driver 34 and column driver 36 connected to print head 32 to apply an image-wise pattern of ink droplets onto ink receiver 40 in synchronization with the motion of ink receiver 40.

The invention has been described in detail with particular reference to certain preferred embodiments thereof, but it will be understood that variations and modifications can be effected within the scope of the invention.

PARTS LIST

3 substrate
5 polymer layer
7 cover
10 ejector
12 ink chamber
14 nozzle
16 inlet
18 restriction
20 heater resistor

22 ink feed slot
24 transistor
26 row conductor
28 column conductor
30 spacing distance
31 head holder
32 print head
33 conductive adhesive
34 row drivers
36 column drivers
38 printer controller
40 ink receiver
42 receiver driver
52 ejector drivers
54 conductor lines
58 control logic
60 bond pads
62 wire bonds
64 flex circuit
70 doped areas
72 channel
74 gate electrode
76 transistor contacts
78 dielectric layer
80 substrate contact

What is claimed is:

1. A print head comprising:

a substrate;

a plurality of row conductors arranged on the substrate;

a plurality of column conductors arranged on the substrate;

a plurality of ejectors arranged on the substrate in rows and columns, each of the plurality of ejectors including a resistive element arranged over the substrate and a supply passage through the substrate dedicated to each of the plurality of ejectors; and a semiconductor device associated with each resistive element, the semiconductor device being responsive to a signal from one of the plurality of row conductors or one of the plurality of column conductors to actuate the resistive element associated with the semiconductor device, the semiconductor device including first and second electrical contacts and a gate, wherein each resistive element is electrically connected to either one of the plurality of row conductors or one of the plurality of column conductors and the first electrical contact of the semiconductor device, the gate of the semiconductor device is electrically connected to the other of either the one of the plurality of row conductors or one of the plurality of column conductors, and the second electrical contact of the semiconductor device is electrical connected to the substrate.

2. The print head of claim 1, wherein the substrate is stainless steel.

3. The print head of claim 1, wherein the substrate is silicon.

4. The print head of claim 3, wherein the silicon is doped to permit sufficient current to flow through the substrate to actuate the ejector.

5. The print head of claim 1, further comprising:

an electrically conductive contact connected to the substrate to complete a power transmission circuit to the semiconductor device.

6. The print head of claim 5, wherein the electrically conductive contact provides fluid to each of the plurality of ejectors.

7. The print head of claim 5, further comprising:

an electrically conductive adhesive positioned to provide a physical attachment and an electrical connection between the substrate and the electrically conductive contact.

8. The print head of claim 1, wherein the semiconductor device includes a thin film transistor.

9. The print head of claim 1, wherein the substrate is a single crystal silicon and the semiconductor device includes a transistor formed in the single crystal silicon.

10. The print head of claim 1, wherein the plurality of ejectors arranged on the substrate in rows and columns are arranged on the substrate in a staggered array.

11. The print head of claim 1, the plurality of ejectors arranged on the substrate in rows and columns row including a column pitch and a row pitch, wherein the column pitch is greater than the row pitch.

12. A print head comprising:

a substrate;

a plurality of row conductors arranged on the substrate;

a plurality of column conductors arranged on the substrate;

a plurality of ejectors arranged on the substrate in rows and columns, each of the plurality of ejectors including a resistive element arranged over the substrate and a supply passage through the substrate dedicated to each of the plurality of ejectors; and a semiconductor device associated with each resistive element, the semiconductor device being responsive to a signal from one of the plurality of row conductors or one of the plurality of column conductors to actuate the resistive element associated with the semiconductor device, wherein the plurality of ejectors arranged on the substrate in rows and columns are arranged on the substrate in a staggered array, the staggered array including a column pitch and a row pitch, wherein the column pitch is greater than the row pitch.

13. A method of actuating print head ejectors comprising:

providing a substrate;

providing a plurality of row conductors arranged over the substrate;

providing a plurality of column conductors arranged over the substrate;

providing a plurality of ejectors arranged on the substrate in rows and columns, each of the plurality of ejectors including a resistive element arranged over the substrate and a supply channel through the substrate dedicated to each of the plurality of ejectors;

providing a semiconductor device associated with each resistive element, the semiconductor device being responsive to a gate signal from one of the plurality of row conductors or one of the plurality of column conductors and power from the other of the plurality of row conductors or one of the plurality of column conductors, the semiconductor device being electrically connected to the substrate;

actuating a row of ejectors by a. providing voltage corresponding to an actuating state or a non-actuating state to each column conductor; and b. providing an enabling gate signal to one of the row conductors; and actuating another row of ejectors by repeating steps a. and b. for another row of ejectors.

14. The method of claim 13, further comprising: sequentially repeating steps a. and b. for each row of ejectors.

* * * * *